United States Patent [19]

Wimberger

[11] Patent Number: 4,901,449

[45] Date of Patent: Feb. 20, 1990

[54] TRI-FLOTATION AIR BAR

[75] Inventor: Richard J. Wimberger, DePere, Wis.

[73] Assignee: W. R. Grace & Co.-Conn., Lexington, Mass.

[21] Appl. No.: 203,072

[22] Filed: Jun. 7, 1988

[51] Int. Cl.[4] ..... F26B 13/00

[52] U.S. Cl. ..... 34/156; 34/41

[58] Field of Search ..... 34/156, 160, 155, 41; 226/97

[56] References Cited

U.S. PATENT DOCUMENTS

| | | | |
|---|---|---|---|
| 2,492,974 | 1/1950 | Dungler . | |
| 3,198,499 | 8/1965 | Stanley . | |
| 3,672,066 | 6/1972 | Stephansen . | |
| 3,827,639 | 8/1974 | Relue et al. . | |
| 3,873,013 | 3/1975 | Stibbe . | |
| 3,982,327 | 9/1976 | Kurie et al. . | |
| 4,137,644 | 2/1979 | Karlsson . | |
| 4,197,971 | 4/1980 | Stibbe . | |
| 4,197,973 | 4/1980 | Stibbe . | |
| 4,201,323 | 5/1980 | Stibb et al. . | |
| 4,265,384 | 5/1981 | Daane . | |
| 4,274,210 | 6/1981 | Stengard . | |
| 4,292,745 | 10/1981 | Caratsch . | |
| 4,425,719 | 1/1984 | Klein et al. . | |
| 4,472,888 | 9/1984 | Spiller | 34/160 X |
| 4,768,695 | 9/1988 | Stibbe | 34/156 X |

FOREIGN PATENT DOCUMENTS 768851 10/1967 Canada .

*Primary Examiner*—Henry A. Bennet

*Attorney, Agent, or Firm*—Hugh D. Jaeger

[57] ABSTRACT

Air flotation bar for use in floating and drying continuous webs of material in a dryer using dimensionally enlarged air bars. Air flows through three Coanda air slots to provide an air flow distributed over a large area of a passing web to maintain heat transfer capabilities and flotation capabilities. A central Coanda slot air impinges against a web for enhanced heat transfer while outer Coanda slots create a flotation pressure pad.

35 Claims, 7 Drawing Sheets

TRI-FLOTATION AIR BAR

BACKGROUND OF THE INVENTION

1. Field of the Invention

The present invention relates to an air flotation bar for use in positioning, drying or curing of a continuous planar flexible material such as a printed web, news print, film material or sheet plastic. The present invention more particularly pertains to an air flotation bar which includes two individual air bars in the upper region of the air flotation bar, each having a Coanda slot about its longitudinal outer edge and a third Coanda slot between the two air bars. The outer Coanda slots provide for web flotation and heat transfer, and the third Coanda slot between the outer air bars provides for additional heat transfer air flow and flotation by air impinging upon the web.

2. Description of the Prior Art

Prior art air flotation bars have been up-scaled in physical size to provide an air bar twice the original size for higher flotation clearance and better web control. The detrimental effect of up-sizing is the degradation of the heat transfer coefficient.

The present invention overcomes the disadvantages of the prior art by providing an air flotation bar where the same flotation capability is maintained, as well as enhanced heat transfer. Three small Coanda air slots instead of two larger Coanda air slots provide for an equal Coanda air flow orifice area in addition to a substantially equal distributed air flow.

SUMMARY OF THE INVENTION

The general purpose of the present invention is to provide an air flotation bar for use in the drying of a web in a dryer, and more particularly, provides an air flotation bar which includes parallel air bars aligned longitudinally along the upper regions of an air bar header. Channeled pressurized air passes through Coanda slots located about and along the parallel air bars. A Coanda slot is located at the outer edge of the air bar, and a third Coanda slot is located between the air bars. The outer Coanda slots provide for flotation and drying of the web, and the third inner Coanda slot between the air bars aids in flotation and further enhances the drying process through heat transfer by providing more impingement air flow to the web.

According to one embodiment of the present invention, there is provided an air flotation bar with longitudinal parallel mounted air bars mounted about the upper regions of an air bar header. Coanda slots are formed along the outer longitudinal edges of each air bar and a third Coanda slot is formed between the inner longitudinal edges of the air bars. A support channel member is placed longitudinally across the greater portion in the upper region of the air flotation bar to support the inner ends of the air bars. Individual chambers with perforated elements direct pressurized air from the intermediate regions of the air flotation bar to each of the Coanda slots. Another larger chamber with perforations in the intermediate region and beneath each of the individual chambers uniformly channels pressurized air to each of the smaller individual chambers. Another chamber in the lower region in turn delivers air to the chamber in the intermediate region.

One significant aspect and feature of the present invention is an air flotation bar with three air slots.

Another significant aspect and feature of the present invention is the ability to increase the size of the air flotation bar and maintain the same flotation capability without loss of the heat transfer coefficient.

A further significant aspect and feature of the present invention is the use of three smaller sized Coanda slots instead Of two normal sized Coanda slots, providing for a more widely distributed uniform drying air flow with enhanced heat transfer.

Having thus described the embodiments of the present invention, it is a principal object hereof to provide an air flotation bar utilizing three Coanda slots in a single air bar structure for the drying of a traversing web in a dryer.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
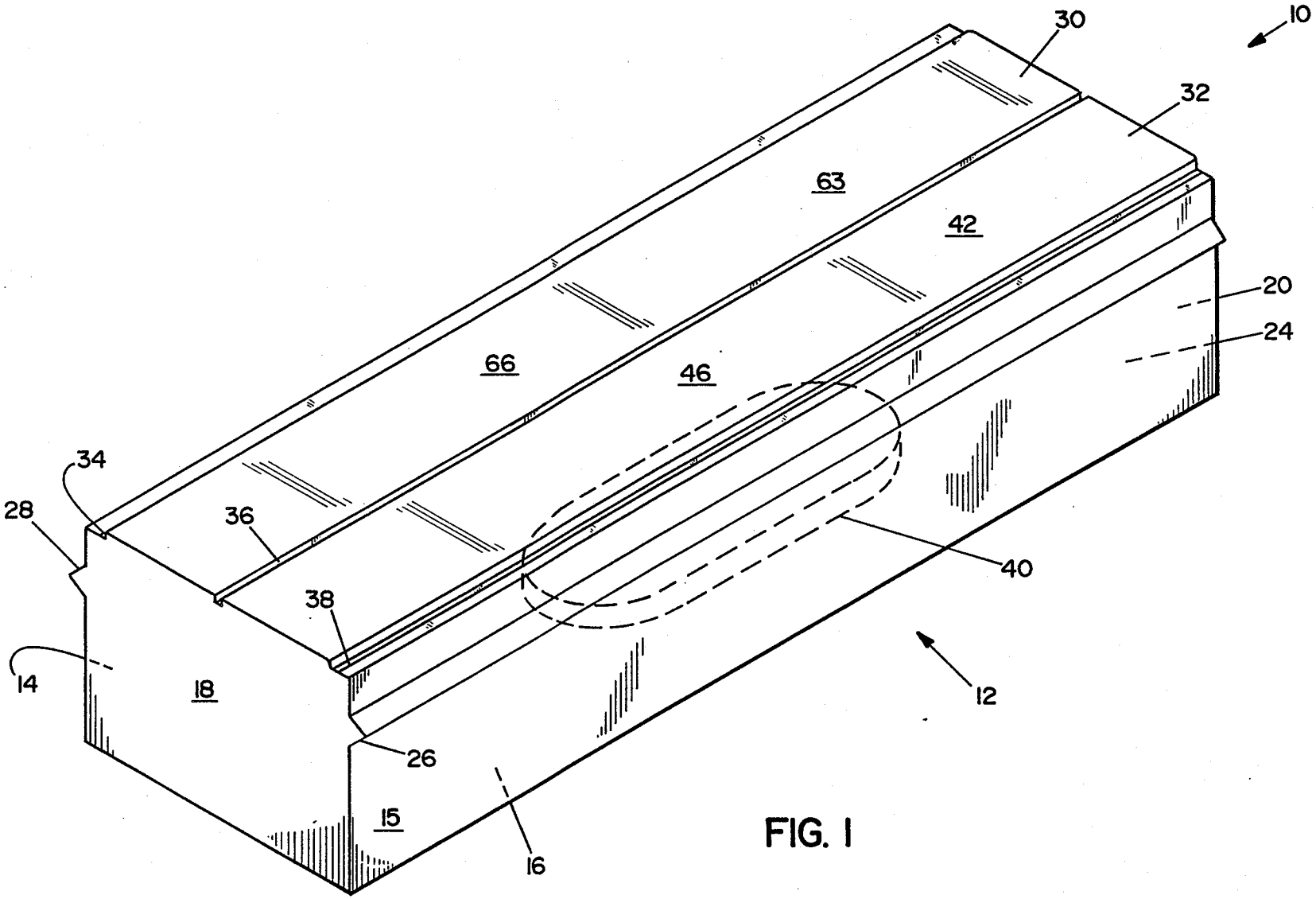
FIG. 1 illustrates a perspective view of an air flotation bar, the present invention.
Figure 4:
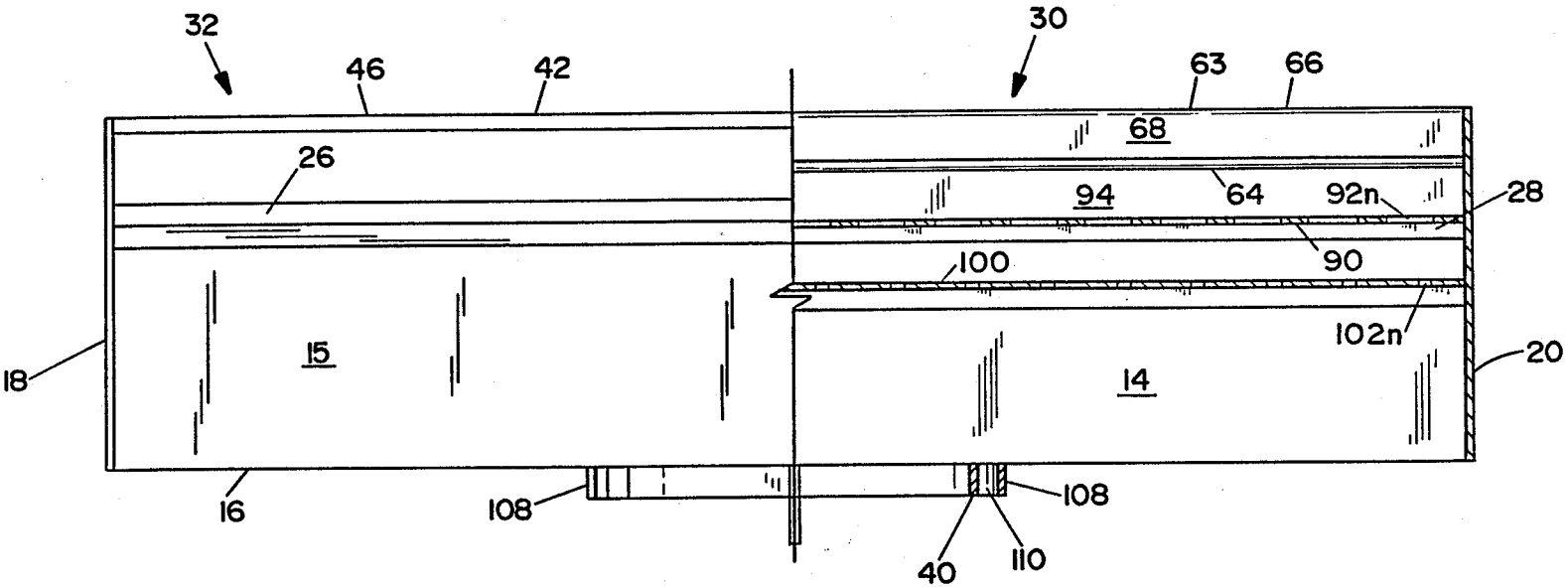
FIG. 4 illustrates a partial front view and a partial cutaway view taken along line 4—4 of FIG. 3.

FIG. 1 illustrates a perspective view of an air flotation bar 10 for use in a web dryer. Externally visible members in the figure illustrate the air flotation bar 10 including a channel like air bar header 12 with opposing canted sides 14 and 15, and a bottom 16. Opposing and parallel vertically aligned air bar header end plates 18 and 20 affix between the sides 14 and 15 with each end plate having an air bar alignment tab 22 and 24, as also illustrated in FIG. 4. Holes, slots or other various openings can be fabricated in the air bar alignment tabs 22 and 24 for securing, mounting or positioning of the air flotation bar 10 in a dryer. V channels 26 and 28 are formed in and aligned horizontally in sides 15 and 14, respectively, to accommodate air bar mounting flanges, as later described in detail. Air bars 30 and 32 align longitudinally in a precise manner between the upper regions of sides 14 and 15 longitudinally to form aligned Coanda slots 34, 36, and 38 as illustrated. Two outer Coanda slots 34 and 38 position as illustrated with an inner third Coanda slot 36 between air bars 30 and 32. An oval shaped air inlet 40 positions on the bottom 16 to accept dryer system air flow for the air flotation bar 10.

Figure 2:
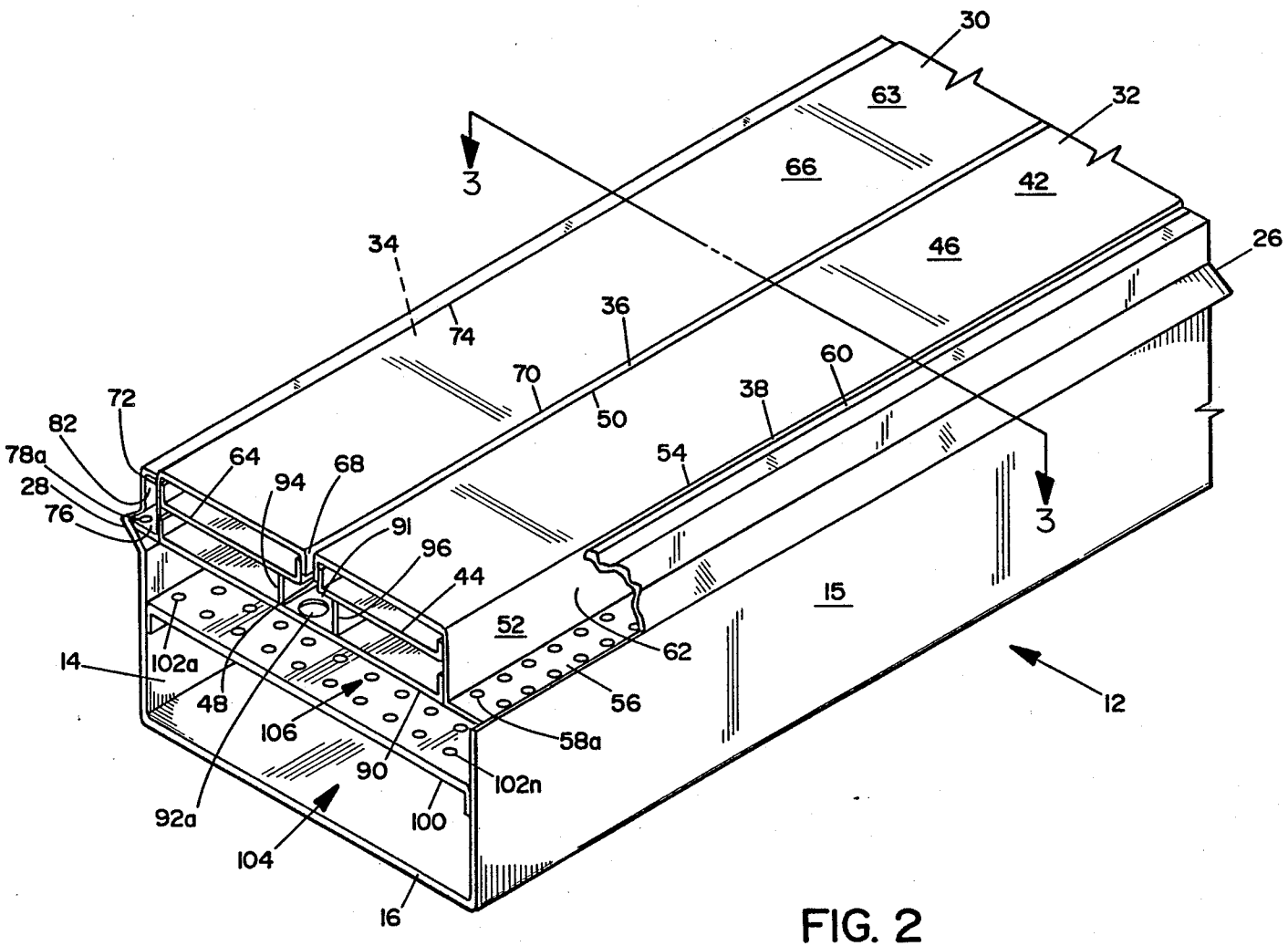
FIG. 2 illustrates a partial cutaway view of the air bar header with the header end plate removed.

FIG. 2 illustrates a partial cutaway view of the air flotation bar 10 with the air bar header end plate 18 removed for purposes of the illustration. All numerals correspond to those elements previously described. Reference to this FIG. and FIG. 3 also facilitates an understanding of the following disclosed subject matter. Air bars 30 and 32 are mirror images of each other, and position between the upper regions of sides 14 and 15. Air bar 32 includes an upper air bar channel member 42 and a lower air bar channel member 44 tightly secured and affixed within the upper air bar channel member 42 forming an air bar chamber. The upper air bar channel member 42, with several integral and planar members, includes a horizontal planar surface 46, which intersects an inner vertical surface 48 to form a uniform defined radius Coanda curve 50, and also intersects an outer vertical surface 52 to form a uniform defined radius Coanda curve 54. The outer vertical surface 52 is bent at a right angle to form a horizontally aligned flange member 56 which in turn is accommodated by the V channel 26. The flange member 56 includes a plurality of holes 58*a*–58*n* where hole 58*a* and other like holes in the series are illustrated in the figure. A lip 60*a* of a sidewall 60 extends a finite distance inwardly at a right angle from the upper region of side 15 and on a plane lower than that of the horizontal planar surface 46 of the air bar 32 to form a Coanda slot 38 of a finite distance between the lip 60*a* and Coanda curve 54. An outer chamber 62 is also formed by the flange member 56, the upper portion of side 15, the outer vertical surface 52 and lip 60*a*. Air bar 30 is constructed in a like and similar manner to that of air bar 32, and includes a horizontal planar surface 66, an inner vertical surface 68, a Coanda curve 70, an outer vertical surface 72, a Coanda curve 74, a flange member 76, holes 78*a*–78*n* where only hole 78*a* and the other like holes in the series are illustrated, a lip 80*a* of sidewall 80 and an outer chamber 82.

A support channel member 90 positions between the outer vertical surface 52 and outer vertical surface 72, and includes a plurality of orifices 92*a*–92*n* where only orifice 92*a* is illustrated. Vertically oriented struts 94 and 96 are positioned perpendicular on the support channel member 90 to support the inner ends of air bars 30 and 32, thus stabilizing the geometrical configuration of the inner Coanda slot 36 and forming outer support chambers 62 and 82. A central support chamber 91 is formed by struts 94 and 96, the support channel member 90, and the lower portions of the air bar channel members 44 and 64. A diffuser plate 100, including a plurality of holes 102*a*–102*n* secured between sides 14 and 15, and below the support channel member 90, provide for even flow of drying air from the oval shaped air inlet 40 of FIGS. 1 and 3. The diffuser plate 100, sides 14 and 15, air bar header end plates 18 and 20 of FIG. 1, and the bottom 16 define a first lower air flow chamber 104. The portions of the sides 14 and 15 just below the V channels 26 and 28, air bar header end plates 18 and 20, the support channel member 90 and the flange members 56 and 76 define a second upper diffused air flow chamber 106. An angled oval member 108 secures to the bottom 16 and adjacent to and about the oval shaped air inlet 40 to form a gasket chamber 111 about the oval shaped air inlet 40 as illustrated in FIG. 3.

Figure 3:
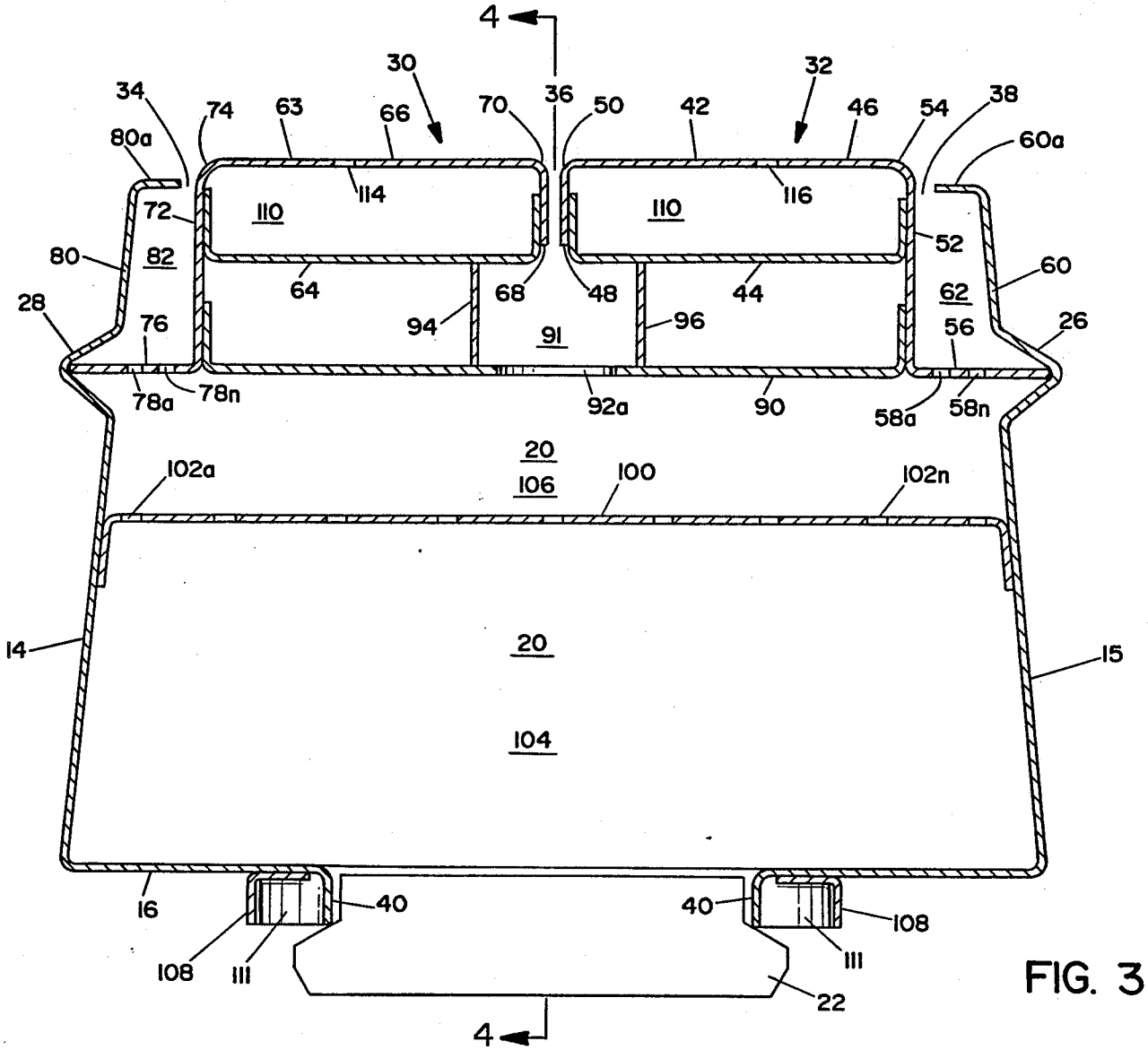
FIG. 3 illustrates a cross-sectional view of the air flotation bar taken along line 3—3 of FIG. 2.

FIG. 3 illustrates a cross-sectional view of the present invention taken along line 3—3 of FIG. 2 where all numerals correspond to those elements previously described.

FIG. 4 illustrates a partial front view and partial cutaway view taken along line 4—4 of FIG. 3 of the air flotation bar where all numerals correspond to those elements previously described.

MODE OF OPERATION

Figure 5:
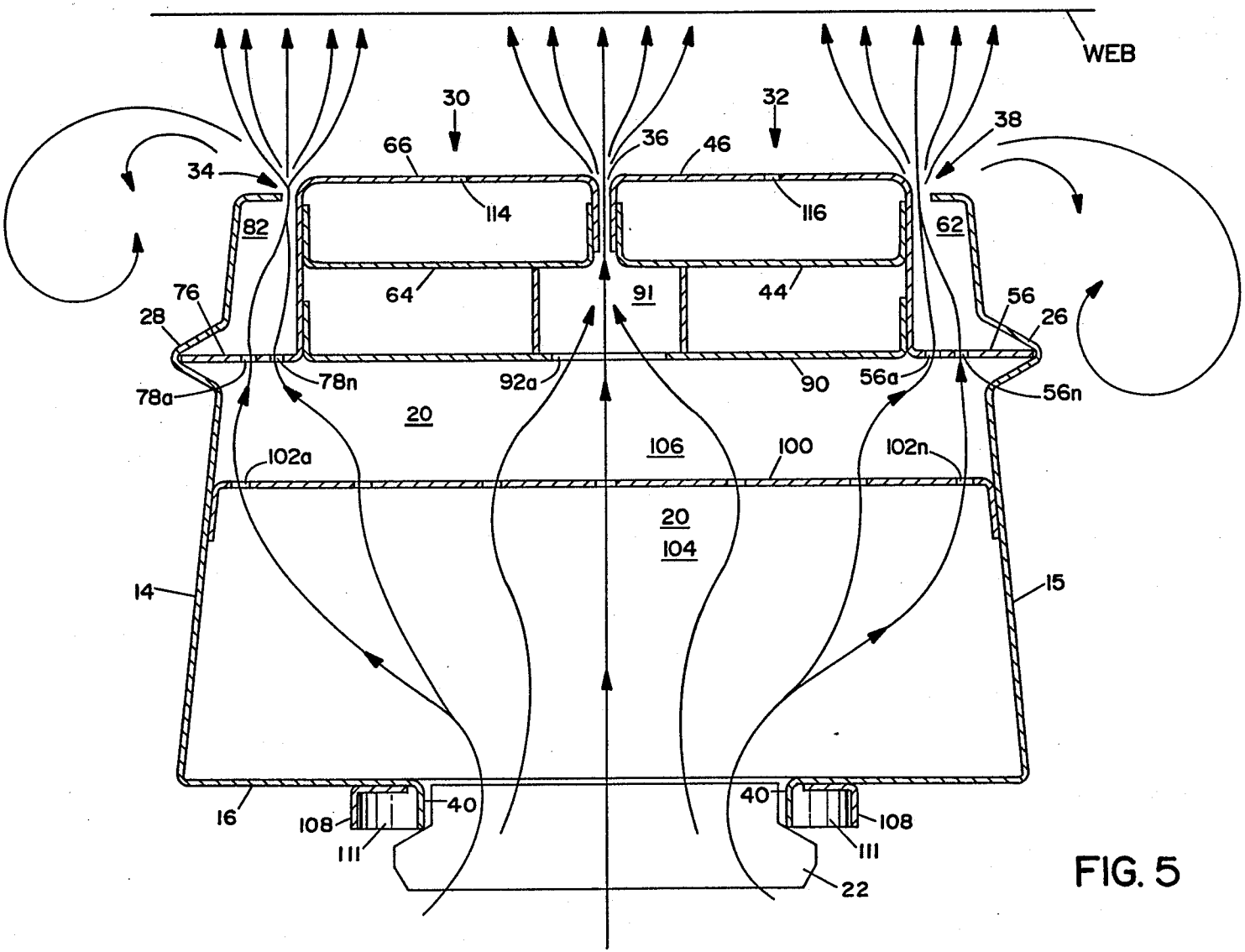
FIG. 5 illustrates a view of FIG. 3 including the air flow in and about the air flotation bar.

FIG. 5 illustrates a view of FIG. 3 with air flow in and about the air flotation bar 10 where all numerals correspond to those elements previously described. Dryer system air flows first through the oval shaped air inlet 40 and out of the Coanda slots 34, 36 and 38 as previously described. Air passing through the Coanda slots 34, 36, and 38, forms a broad air flow area to support a web. Air passing through the Coanda slot 36 projects and moves upwardly to, in effect, widen the distance between the flow of air flowing along towards the web and to provide a wider upper flow area beneath the web. The drying air flow has a wider foot print to provide a larger more effective drying area with heat transfer on the web.

Dryer system air flow passes first through the oval shaped air inlet 40 of FIG. 3, through the first lower air flow chamber 104, through the diffuser plate 100 where the air flow is distributed evenly and diffused through the second upper diffused air flow chamber 106, and simultaneously through a plurality of holes 58*a*–58*n*, 78*a*–78*n*, and 92*a*–92*n* into chambers 62, 82, and 91, respectively. The diffuser plate straightens the air flow. Any other like structure which creates a pressure drop would act as a flow straightener. The air flow then continues from chambers 62, 82, and 91, and through Coanda slots 38, 34 and 36. The width of each slot is about 0.035–0.2" by way of example and for purposes of illustration and not to be construed as limiting of the present invention, and in a range of preferably about 1.3–1.9% open area of the plane. The open area of the slots is in a range of 1–5% of the open area of the plane.

DESCRIPTION OF A FIRST ALTERNATIVE EMBODIMENT

Figure 6:
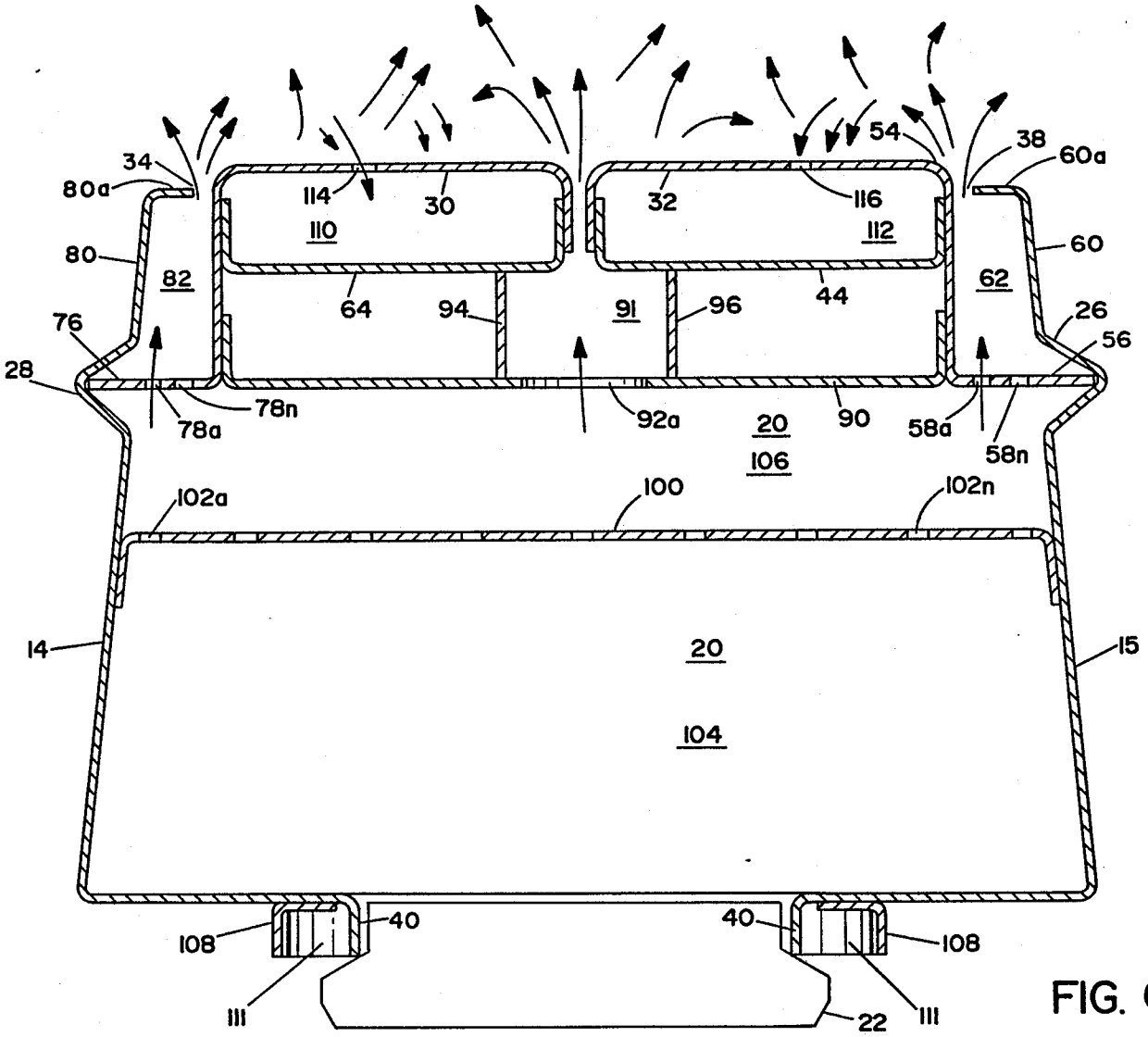
FIG. 6 illustrates an alternative embodiment including air flow in and about an air flotation bar with negative pressure in the interior air bar channel members; and, FIG. 7 illustrates an alternative embodiment in cross section of an air bar including air flow in and about the air flotation bar.

FIG. 6 illustrates an alternative embodiment of the air flotation bar where all numerals correspond to those elements previously described. Negative pressure is applied to the interior chambers 110 and 112 of air bars 30 and 32 to create an area of low pressure in the areas of longitudinal holes 114 and 116, thus affecting air flow from the outer and inner Coanda slots 34 and 38, and 36, respectively, in the manner as illustrated by the air flow arrows.

DESCRIPTION OF A SECOND ALTERNATIVE EMBODIMENT

Figure 7:
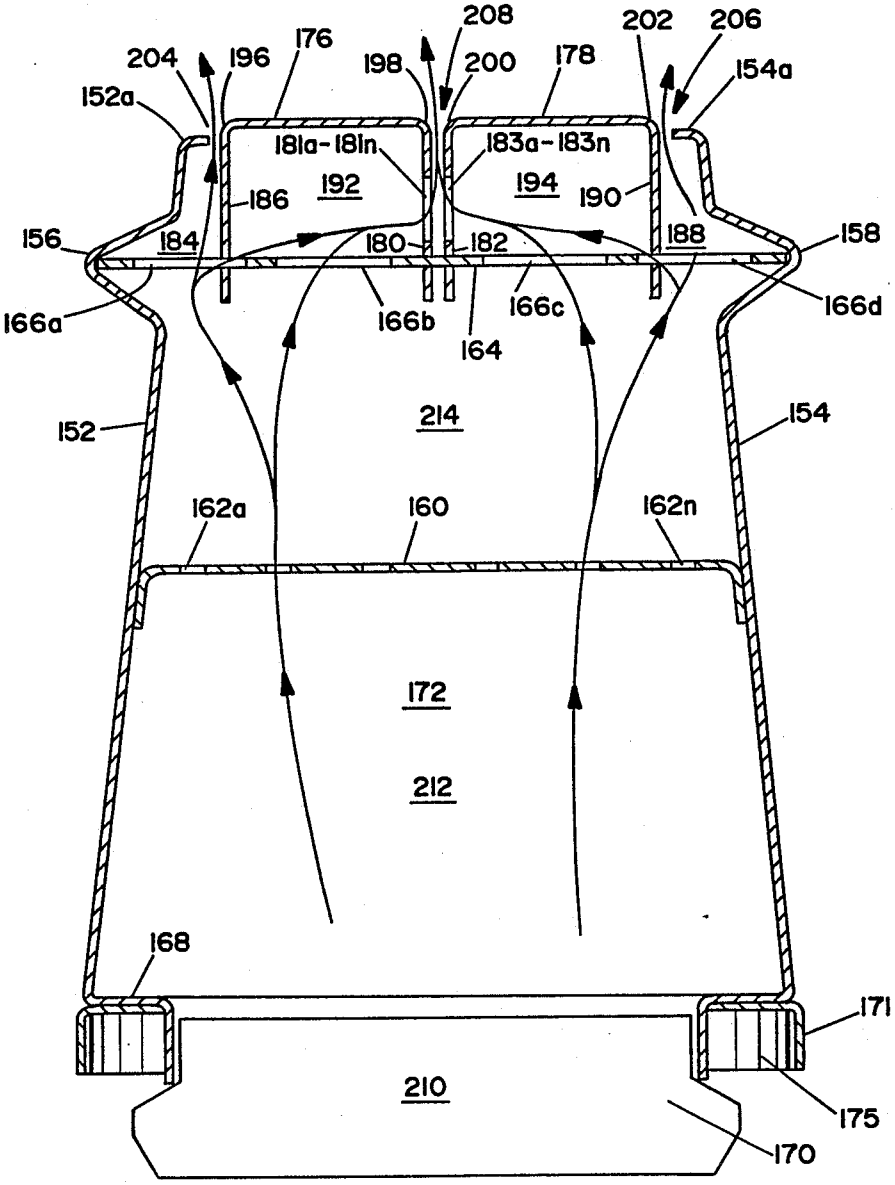

FIG. 7 illustrates an alternative embodiment in cross section of an air flotation bar 150 including sides 152 and 154, V channels 156 and 158, a diffuser plate 160 between sides 152 and 154, and a plurality of holes 162*a*–162*n* in the diffuser plate 160. A perforated support member 164 secures between the V channels 156 and 158. Longitudinal rows of perforations 166*a*–166*d* are in the perforated support member 164. A bottom 168 is between the sides 152 and 154. An oval shaped air inlet 170 locates on the bottom 168, and an angled oval member 171 forms a gasket chamber 175. Similar opposing ends 172 and 174, of which 172 is illustrated, and U shaped channel member 176 and 178 secure to the perforated support member 164. The top portion of the U shaped channel members 176 and 178 extend above lips 152*a* and 154*a* of sides 152 and 154, respectively. The U shaped channel members 176 and 178 include a plurality of holes 181*a*–181*n* and 183*a*–183*n* extending longitudinally along the inner walls 180 and 182 of the U shaped channel members 176 and 178. A series of chambers 184, 192, 194 and 188 are formed in the upper regions of the air flotation bar 150 as now described in detail. A chamber 184 is formed by the upper portion of the side 152 above the V channel 156, lip 152*a*, the perforated support member 164, the outer wall 186 of the U shaped channel member 176, and ends 174 and 172. Chamber 188 is also formed by the upper portion of the side 154 above the V channel 156, lip 154*a*, the perforated support member 164, the outer wall 190 of the U shaped channel member 178, and ends 172 and 174. Chambers 192 and 194 are formed between U shaped channel members 176 and 178, the perforated support member 164, and ends 172 and 174. Coanda curves 196, 198, 200 and 202 are located at the corners of the U shaped channel members 176 and 178. Coanda slot 204 is formed by lip 152*a* and Coanda curve 196. Coanda slot 206 is formed by lip 154*a* and Coanda curve 202. Coanda slot 208 is formed between inner walls 180 and 182 and the Coanda curves 198 and 200. In operation, air flows through orifice 210 in the bottom member into the lower chamber 212 and then through the holes 162*a*–162*n* into the upper chamber 214. The lower chamber 212 is the region between sides 152 and 154 and ends 172 and 174 and beneath the diffuser plate 160. The upper chamber 214 is the area above the diffuser plate 160 bounded by the diffuser plate 160, sides 152 and 154, ends 172 and 174 and the perforated support member 164. Air flow then proceeds through the plurality of perforations 166*a*–166*d* into the respective chambers 184, 192, 194 and 188. Hole 166*a* is in common with chambers 184 and 192 and hole 166*d* are in common with chamber 194 and 188. Air passing through a plurality of holes 166*a* and 166*d* passes into chambers 184 and 188, divides and partially flows into chamber 192 and 194, respectively. Air contained in chamber 184 and 188 pass through the Coanda slots 204 and 206. Air from chambers 192 and 194 pass through hole pluralities 181*a*–181*n* and 183*a*–183*n* and through the Coanda slot 208. Air flow is illustrated by the arrowed lines.

Various modifications can be made to the present invention without departing from the apparent scope hereof. The air flotation bar can be used for drying of printed webs, coated webs, or any other suitable air flotation applications.

We claim:

1. Air flotation bar comprising:

a. a single chamber air bar header means;

b. three substantially parallel, longitudinal Coanda slots positioned on a top surface of said single chamber air bar header means; and, c. chamber means in said air bar header means for passing air to each of said Coanda slots.

2. Air flotation bar for positioning and drying of a moving web of material comprising:

a. a chamber and a means for flow straightening in said chamber;

b. central support chamber and two support chambers opposing said central support chamber, said central support chamber connected to said chamber;

c. opposing upper air bar channel chambers forming an inner Coanda slot therebetween and above said central support chambers; and, d. side walls with lips positioned about said support chambers and outer sides of said upper air bar channel chambers with a space therebetween forming outer Coanda slots.

3. Air flotation bar for positioning and drying of a moving web of material comprising:

a. a lower air flow chamber, an upper air flow chamber and a means for flow straightening therebetween;

b. central support chamber and two support chambers opposing said central support chamber, said central support chamber connected to said upper air flow chamber;

c. opposing upper air bar channel chambers forming an inner Coanda slot therebetween and above said central support chambers; and, d. side walls with lips positioned about said support chambers and outer sides of said upper air bar channel chambers with a space therebetween forming outer Coanda slots.

4. Air flotation bar of claim 3 wherein each of said Coanda slots are substantially equal in width.

5. Air flotation bar of claim 3 wherein each of said slots is 0.1" wide.

6. Air flotation bar of claim 3 wherein said inner Coanda slot provides enhanced heat transfer.

7. Air flotation bar of claim 3 wherein said outer Coanda slots provide an air pressure pad for substantial flotation of a web.

8. Air flotation bar of claim 3 wherein open area of said slots is 1–5% of open available area.

9. Air flotation bar of claim 3 wherein said open area of said slots is 1.3–1.9% of open available area.

10. Air flotation bar of claim 3 wherein said flow straightening means is a perforated diffuser plate.

11. Air flotation bar of claim 3 comprising:

a. substantially centered longitudinal hole in each of said air bar channel chambers; and, b. means for creating a negative pressure in each of said chambers.

12. Air flotation bar comprising:

a. a bottom member with an inlet hole therein, air bar header end plates affixed to said bottom member, two sides extending upwardly from said bottom member, and a means for creating a pressure drop secured at a midportion of said sides;

b. opposing right angled flanged members secured to said side members, said flanged member including holes in a base thereof, a top edge of said flange and a top edge of said side member forming a Coanda slot about each side member; and, c. a support member with center orifices extending between said flanged members, opposing vertical struts secured about each side of said orifices, opposing lower and upper air bar channels secured between said flange member and said struts and forming a Coanda slot therebetween.

13. Air flotation bar comprising:

a. a bottom member with an inlet hole therein, air bar header end plates affixed to said bottom member, two sides extending upwardly from said bottom member, and a diffuser plate with holes secured at a mid-portion of said sides;

b. opposing right angled flanged members secured to said side members, said flanged member including holes in a base thereof, a top edge of said flange and a top edge of said side member forming a Coanda slot about each side member; and, c. a support member with center orifices extending between said flanged members, opposing vertical struts secured about each side of said orifices, opposing lower and upper air bar channels secured between said flange member and said struts and forming a Coanda slot therebetween.

14. Air flotation bar of claim 13 wherein said corners of said upper air bar channel members are curved.

15. Air flotation bar of claim 13 wherein each of said slots is 0.10" wide.

16. Air flotation bar of claim 13 wherein each of said Coanda slots are substantially equal in width.

17. Air flotation bar of claim 13 wherein said inner Coanda slot provides enhanced heat transfer.

18. Air flotation bar of claim 13 wherein said outer Coanda slots provide an air pressure pad for substantial flotation of a web.

19. Air flotation bar of claim 13 wherein said total area of said slots is 1.3–1.9 of open area of said air flotation bar.

20. Air flotation bar of claim 13 for drying a printed web.

21. Air flotation bar of claim 13 for drying a coated web.

22. Air flotation bar comprising:

a. a bottom member with an inlet hole therein, air bar header end plates affixed to said bottom member, two sides extending upwardly from said bottom member, and a means for creating a pressure drop secured at a mid portion of said side;

b. opposing U shaped channel members secured to a perforated plate, said plate secured to said side members, and each outer edge of said channel member forming a Coanda slot about each side; and, c. a space between said U shaped channel and a plurality of holes on an inner edge of said channel members forming a Coanda slot therebetween.

23. Air flotation bar of claim 22 wherein said corners of said upper air bar channel members are curved.

24. Air flotation bar of claim 22 wherein each of said slots is 0.10" wide.

25. Air flotation bar of claim 22 wherein each of said Coanda slots are substantially equal in width.

26. Air flotation bar of claim 22 wherein said inner Coanda slot provides enhanced heat transfer.

27. Air flotation bar of claim 22 wherein said outer Coanda slots provide an air pressure pad for substantial flotation of a web.

28. Air flotation bar of claim 22 wherein said total area of said slots is 1.3–1.9% of open area of said air flotation bar.

29. Air flotation bar of claim 22 for drying a printed web.

30. Air flotation bar of claim 22 for drying a coated web.

31. Air flotation bar for positioning and drying of a moving web of material comprising:

a. a chamber;

b. central support chamber and two support chambers opposing said central support chamber, said central support chamber connected to said chamber;

c. opposing upper air bar channel chambers forming an inner Coanda slot therebetween and above said central support chambers; and, d. side walls with lips positioned about said support chambers and outer sides of said upper air bar channel chambers with a space therebetween forming outer Coanda slots.

32. Air flotation bar for positioning and drying of a moving web of material comprising:

a. a lower air float chamber and an upper air flow chamber;

b. central support chamber and two support chambers opposing said central support chamber, said central support chamber connected to said upper air flow chamber;

c. opposing upper air bar channel chambers forming an inner Coanda slot therebetween and above said central support chambers; and, d. side walls with lips positioned about said support chambers and outer sides of said upper air bar channel chambers with a space therebetween forming outer Coanda slots.

33. Air flotation bar comprising:

a. a bottom member with an inlet hole therein, air bar header end plates affixed to said bottom member and two sides extending upwardly from said bottom member;

b. opposing right angled flanged members secured to said side members, said flanged member including holes in a base thereof, a top edge of said flange and a top edge of said side member forming a Coanda slot about each side member; and, c. a support member with center orifices extending between said flanged members, opposing vertical struts secured about each side of said orifices, opposing lower and upper air bar channels secured between said flange member and said struts and forming a Coanda slot therebetween.

34. Air flotation bar comprising:

a. a bottom member with an inlet hole therein, air bar header end plates affixed to said bottom member and two sides extending upwardly from said bottom member;

b. opposing right angled flanged members secured to said side members, said flanged member including holes in a base thereof, a top edge of said flange and a top edge of said side member forming a Coanda slot about each side member; and, c. a support member with center orifices extending between said flanged members, opposing vertical struts secured about each side of said orifices, opposing lower and upper air bar channels secured between said flange member and said struts and forming a Coanda slot therebetween.

35. Air flotation bar comprising:

a. a bottom member with an inlet hole therein, air bar header end plates affixed to said bottom member and two sides extending upwardly from said bottom member;

b. opposing U shaped channel members secured to a perforated plate, said plate secured to said side members, and each outer edge of said channel member forming a Coanda slot about each side; and, c. a space between said U shaped channel and a plurality of holes on an inner edge of said channel members forming a Coanda slot therebetween.

* * * * *